United States Patent [19]

Seavey

[11] Patent Number: 4,636,798

[45] Date of Patent: Jan. 13, 1987

[54] MICROWAVE LENS FOR BEAM BROADENING WITH ANTENNA FEEDS

[75] Inventor: John M. Seavey, Cohasset, Mass.

[73] Assignee: Seavey Engineering Associates, Inc., Cohasset, Mass.

[21] Appl. No.: 614,515

[22] Filed: May 29, 1984

[51] Int. Cl.[4] ..... H01Q 19/06

[52] U.S. Cl. ..... 343/753; 343/783

[58] Field of Search ..... 343/753, 754, 755, 783, 343/909

[56] References Cited

U.S. PATENT DOCUMENTS

| | | | |
|---|---|---|---|
| 2,761,138 | 8/1956 | Sherman | 343/783 |
| 3,434,146 | 3/1969 | Petrich | 343/772 |
| 3,611,392 | 3/1971 | Knox et al. | 343/783 |

*Primary Examiner*—Eli Lieberman

*Attorney, Agent, or Firm*—Charles Hieken

[57] ABSTRACT

A microwave lens broadens the radiation pattern of an antenna feedhorn so as to result in improved illumination of the reflector surface. The lens, constructed of dielectric material in the shape of a half-torus, provides feed radiation patterns suitable for use with deep paraboloidal reflectors, typically ones having focal-length-to-diameter ratios between 0.25 and 0.35.

7 Claims, 9 Drawing Figures

MICROWAVE LENS FOR BEAM BROADENING WITH ANTENNA FEEDS

The present invention relates in general to microwave lenses and more particularly concerns a novel microwave lens for broadening the radiation pattern of an antenna feed horn to improve illumination of the reflector surface over a broad frequency range without regard to the incident polarization.

Earth Stations for reception of satellite signals presently use the 3.7–4.2 GHz and the 11.7–12.7 GHz frequency bands (for commercial use) and require reflector antennas having diameters ranging from 6 to 24 feet. Because of the requirements for high gain and low noise qualities from these antennas, prior techniques for feeding these reflectors have used (among others), simple corrugated face ("scalar" ) feeds which are excited by the fundamental mode of a circular waveguide. These types of feeds are well-known for producing good performance in these installations because they efficiently illuminate reflectors having focal length to diameter (F/D) ratios of about 0.4 and larger, while at the same time reducing electrical noise pickup from the earth or from nearby interfering transmitters.

However, many reflectors in use have relatively short focal lengths, or small F/D ratios with consequent large opening angles. F/D ratios ranging down to 0.25 with opening angles of 90° are in use; very many reflectors with F/D ratios of 0.3 and opening angles of 80° are in service at present.

When a typical scalar feed is used to illuminate a "deep" reflector, the antenna gain is not optimum. An alternative feed design is a dipole placed in front of the scalar face.

Other attempts to broaden the feed pattern make the cylindrical opening of the circular waveguide extend beyond the corrugated face. This technique does not substantially broaden the feed pattern for all polarizations. Other remedies constrict the opening diameter so as to result in an electrically smaller feed aperture with consequent beam broadening. This method suffers severely from poor impedance match problems resulting from operating the circular waveguide near its cutoff frequency.

Accordingly, it is one object of this invention to provide a device which can be placed over the aperture of a scalar, corrugated face feedhorn to permit broadening its radiation pattern for optimum illumination of relatively "deep" paraboloidal reflectors.

A further object of this invention is to permit efficient illumination of "deep" reflectors for all incident wave polarizations and without attendant problems of impedance mismatch.

According to the invention, there is a dielectric lens shaped generally in the form of a "half-donut" or torus having an inner diameter approximately equivalent to the diameter of the circular waveguide of the mating scalar feed.

In use, the lens is placed in contact with and coaxial with said feed and is affixed thereto by any of several methods including mechanical fasteners, clips, adhesive or special interfaces molded into the lens itself.

The lens provides broadband beam broadening so as to increase the efficiency of "deep" reflectors and does so for all incident polarizations. Therefore, the lens may be applied to antennas requiring dual or circular polarizations.

Furthermore, the lens does not exhibit the disadvantages of poor impedance match or distortion of the apparent phase center of the feed which characterize other approaches to solving this problem.

In addition, it has been found that the lens does not introduce loss into the feed; thus, the figure of merit of the antenna (gain divided by noise temperature) is made to improve.

Numerous other features, objects and advantages of the invention will become apparent from the following specification when read in connection with the accompanying drawing in which.

Figure 6:
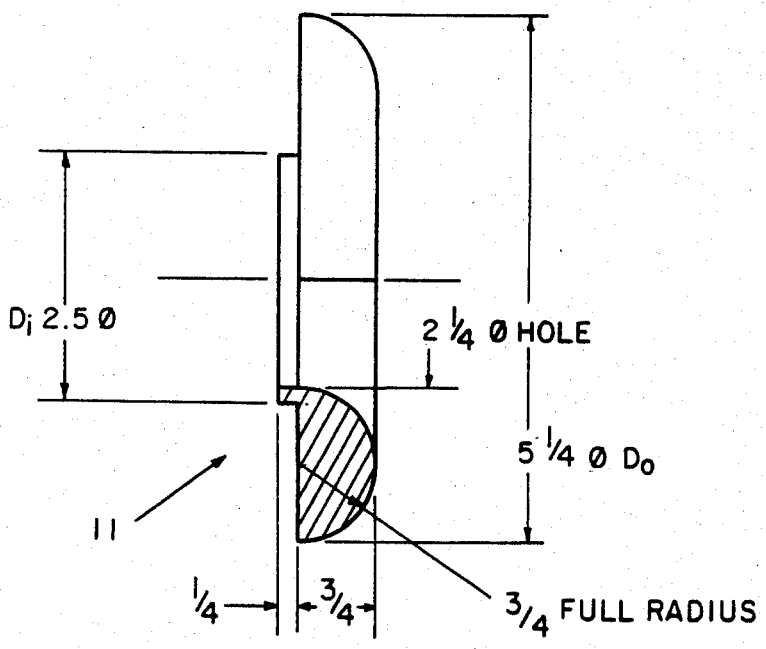
FIG. 6 is a dimensioned drawing of a typical lens according to the invention constructed for optimum performance in the 3.7–4.2 GHz frequency range and using a material with a dielectric constant of approximately 2.5.
Figure 7:
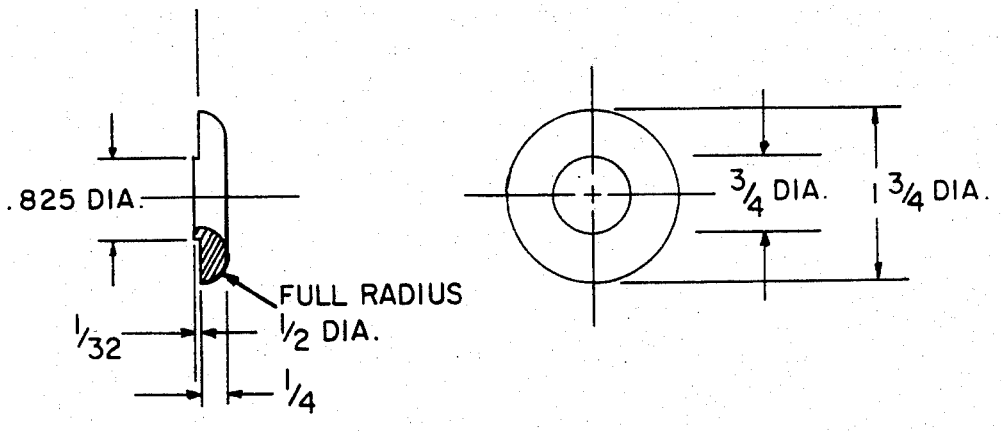
FIG. 7 is a similar drawing of a lens according to the invention optimized for operation in the 11.7–12.7 GHz frequency range and using material with a dielectric constant of approximately 2.1.

With reference now to the drawing and more particularly FIGS. 6 and 7 thereof, there are shown diametrical longitudinal views of a lens according to the invention. Lens 11 basically consists of a torus cut in half. The inner diameter $D_i$ is made approximately equal to the diameter of the circular waveguide of the mating horn. The outer diameter is varied depending on the extent of the beam broadening desired. For −10 dB beamwidths in the range of 160°–170°, the outer diameter $D_o$ is approximately 2.3 times the inner diameter. The outer torus radius is made equal to 30% of the inner diameter. These proportions apply for dielectric materials having dielectric constants in the range of 2.1–2.6 approximately.

For wider beamwidths, in the range of 170°–180° at the −10 dB points, the outer diameter is made approximately 3.0 times the inner diameter and the outer torus radius is made equal to 50% of the inner diameter.

Manufacturing tolerances for this lens have not been found to be critical for operation below 14.5 GHz. Typical tolerances of ±1/32" have been found to be adequate. In order to maintain symmetry of the radiation pattern, it has been found to be important to position the lens concentrically with the mating circular waveguide within a tolerance of better than 2% of its inner diameter.

Figure 1:
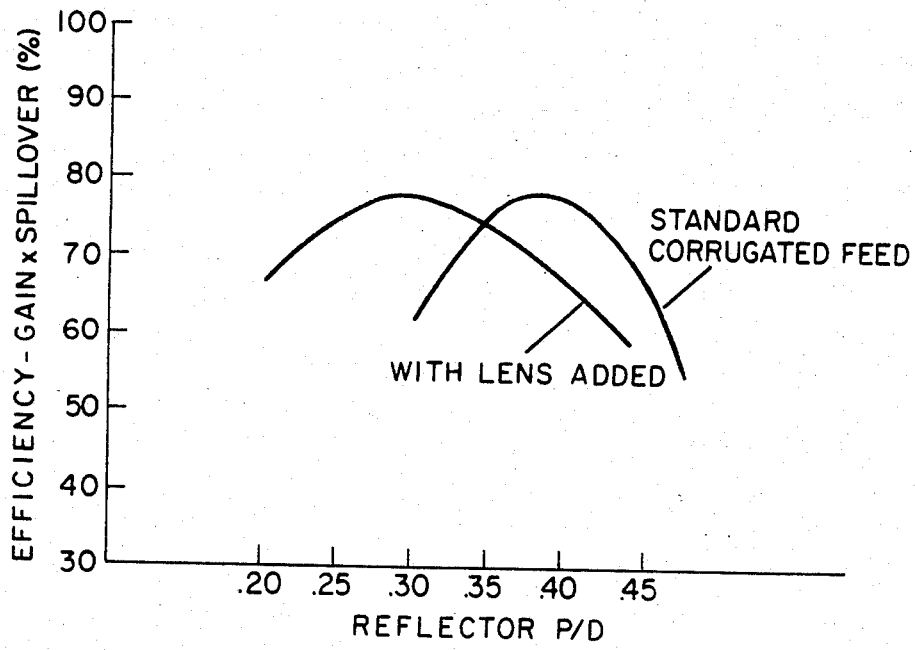
FIG. 1 depicts the gain of a paraboloidal reflector as a function of the F/D ratio for a standard corrugated-face "scalar" feed and also with this same feed equipped with the lens which is the subject of this invention.
Figure 2:
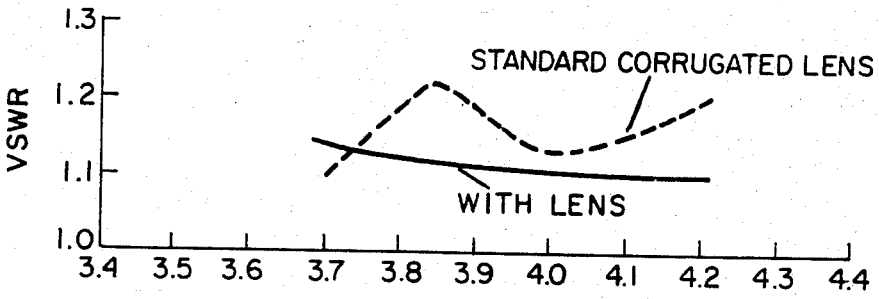
FIG. 2 shows a graph of the VSWR (voltage standing wave ratio) of the standard corrugated-face feed and also with this feed equipped with the lens according to the invention.
Figure 3:
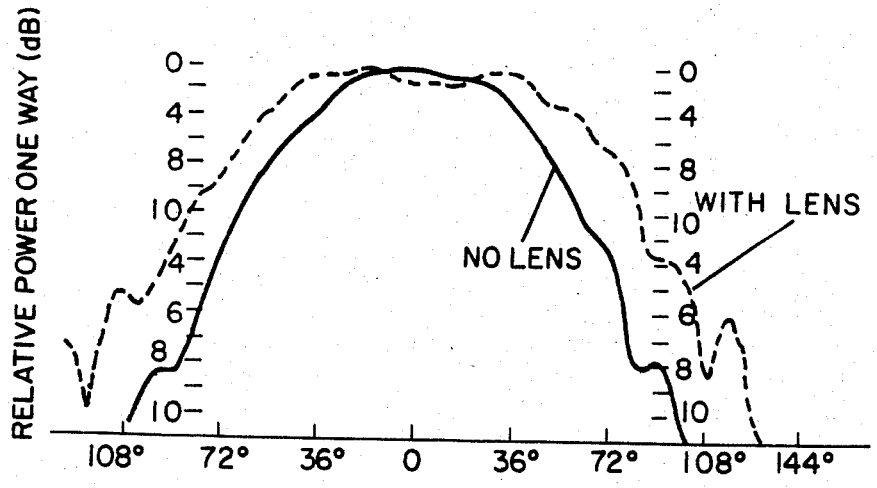
FIG. 3 shows a typical radiation pattern of the standard feed overlaid with a pattern of the same feed with the lens according to the invention.
Figure 4:
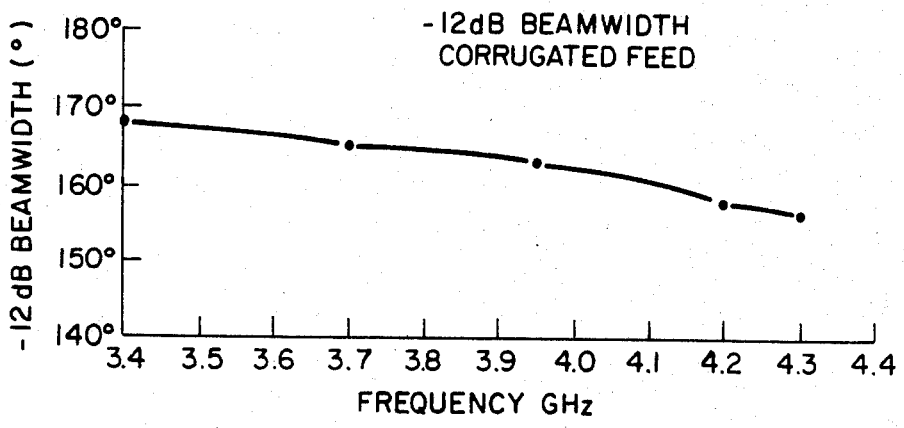
FIG. 4 illustrates the broad frequency band performance of the subject lens and graphs the −10 dB beamwidth versus frequency according to the invention.
Figure 5:
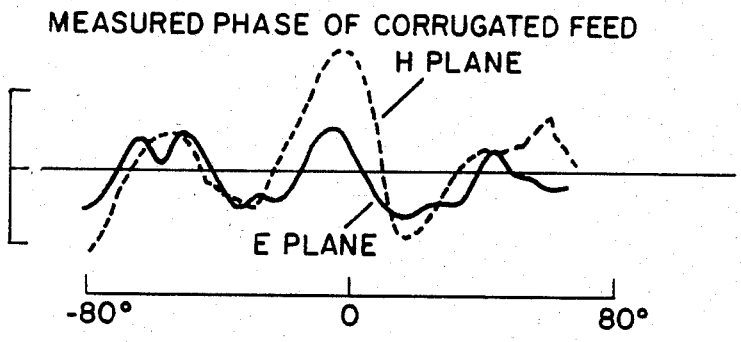
FIG. 5 is a graph showing the measured phase front from a typical scalar feed using the subject lens according to the invention.

Referring to FIG. 1, there is shown the gain of a paraboloidal reflector as a function of the F/D ratio for a standard corrugated-face "scalar" feed and the gain with this same feed equipped with a lens according to the invention of the type shown in FIGS. 6 and 7. Maximum gain occurs for an F/D ratio of about 0.37 whn illuminating a deep reflector with a typical scalar feed. A reflector with an F/D ratio of 0.30 suffers a gain loss of 1.2 dB when illuminated with a typical scalar feed. Note the increased gain at lower F/D ratio upon adding lens 11.

FIGS. 2–5 depict measured performance of the lens according to the invention and show the improvement in radiation pattern illumination, the maintenance of good impedance match and the constancy of phase center variation afforded by the invention over a broad frequency band.

This performance is afforded because lens 11 serves to refract microwave energy present near the inner diameter of the mating circular waveguide to angles far away from the axis of symmetry. Because the physical effect is refraction, this behavior is, to a first approximation, independent of the incident polarization. Also, because the lens does not block a significant portion of the aperture of the circular waveguide, reflections from the lens are found to be very small.

Figure 8A:
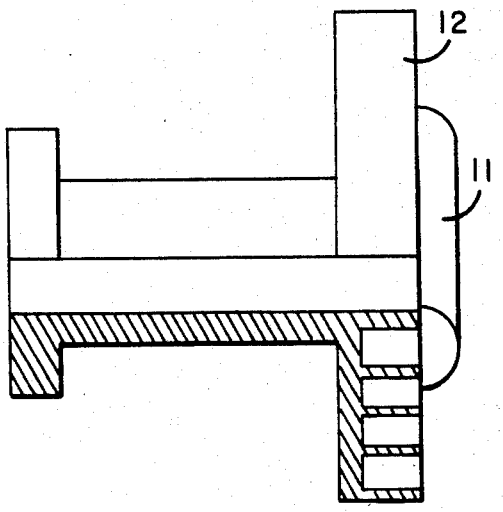
FIG. 8 shows a lens on a typical feedhorn according to the invention.
Figure 8B:
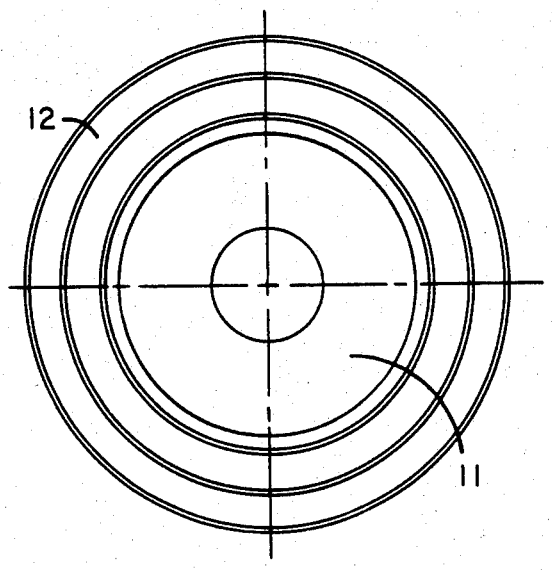

Referring to FIGS. 8A and 8B, there are shown side partially in section and front views, respectively, of the lens according to the invention mounted in a typical antenna feed horn. Lens 11 is shown mounted in circular scalar corrugated feed horn 12 in coaxial relationship.

There has been described novel apparatus for improving the gain and efficiency of deep paraboloidal reflectors through the use of a rotationally-symmetric dielectric lens placed in front of a corrugated-face horn antenna feed. Advantages of this feeding method have been described as improving illumination efficiency without degrading spillover efficiency, excellent impedance match, polarization non-dependability, easy retrofit capability, low cost and lightweight construction.

It is evident that those skilled in the antenna art may now make numerous uses and modifications of and departures from the specific apparatus and techniques described herein without departing from the inventive concepts. Consequently, the invention is to be construed as embracing each and every novel feature and novel combination of features present in or possessed by the apparatus and techniques disclosed herein and limited solely by the spirit and scope of the appended claims.

What is claimed is:

1. Apparatus for broadening the radiation pattern of a waveguide horn comprising, a circular waveguide horn formed with a circular aperture, a dielectric lens having rotational symmetry and shaped in the form of a torus cut in half, said lens being formed of low-loss dielectric material, said lens being located over and coaxial with said circular aperture of said circular waveguide horn.

2. Apparatus as described in claim 1 wherein said circular waveguide horn is formed with grooves or corrugations forming a flat (180°) flare.

3. Apparatus as described in claim 1 wherein said circular waveguide horn is formed with grooves or corrugations forming a conical flare angle.

4. Apparatus as in claim 1 wherein said circular horn is formed with an opening of diameter of the order of 0.75 wavelength.

5. Apparatus for broadening the radiation pattern of a waveguide horn in accordance with claim 1 wherein said dielectric lens comprises two contiguous sections, a first of which is characterized by an inner diameter approximately equal to the diameter of said circular aperture and a second section axially displaced from said first section having an outer diameter greater than said inner diameter, said second section being characterized by a semicircular cross section in a plane including the axis of said lens.

6. Apparatus for broadening the radiation pattern of a waveguide horn in accordance with claim 5 wherein said outer diameter is approximately 2.3 times said inner diameter.

7. Apparatus for broadening the radiation pattern of a waveguide horn in accordance with claim 5 wherein said outer diameter is approximately three times said inner diameter.

* * * * *